United States Patent [19]

Ibarrola

[11] Patent Number: 4,860,877

[45] Date of Patent: Aug. 29, 1989

[54] TILTING MULTIPLE PASSAGE RECTANGULAR BLOCK COIN SORTER

[75] Inventor: Jesus E. Ibarrola, Navarra, Spain

[73] Assignee: Azkoyen Industrial, S.A., Peralta, Spain

[21] Appl. No.: 163,735

[22] Filed: Mar. 3, 1988

[30] Foreign Application Priority Data

Mar. 6, 1987 [ES] Spain ..... 8700623
Nov. 30, 1987 [ES] Spain ..... 8703430

[51] Int. Cl.[4] ..... G07F 1/04
[52] U.S. Cl. ..... 194/346; 194/344
[58] Field of Search ..... 194/344, 346, 324, 350, 194/351, 353; 453/3; 209/655; 193/23, 29, DIG. 1

[56] References Cited

U.S. PATENT DOCUMENTS

| | | | |
|---|---|---|---|
| 3,712,441 | 1/1971 | Taylor . | |
| 4,105,105 | 8/1978 | Braum | 194/346 X |
| 4,263,924 | 4/1981 | Johnson . | |
| 4,503,961 | 3/1985 | Chittleborough | 194/346 |
| 4,650,057 | 3/1987 | Koester | 194/346 |

FOREIGN PATENT DOCUMENTS

| | | | |
|---|---|---|---|
| 0603120 | 9/1934 | Fed. Rep. of Germany | 194/346 |
| 625214 | 2/1936 | Fed. Rep. of Germany | 194/346 |
| 3009466 | 9/1981 | Fed. Rep. of Germany | 194/346 |
| 3512579 | 10/1986 | Fed. Rep. of Germany | 194/346 |
| 1066389 | 4/1967 | United Kingdom . | |
| 1486519 | 9/1977 | United Kingdom . | |
| 2105893 | 3/1983 | United Kingdom . | |

*Primary Examiner*—Joseph J. Rolla
*Assistant Examiner*—Edward S. Ammeen
*Attorney, Agent, or Firm*—Bernard, Rothwell & Brown

[57] ABSTRACT

A coin sorter for coin-operated machines including a frame subdivided on the interior into vertical passages for coins, the upper ends of which open out through apertures in a transversely aligned position, and the lower ends of which open out through apertures in two axially shifted positions. The frame is mounted so as to be able to pivot about a medium axis parallel to and near the bottom and is connected to a mechanism that causes the partial tilting of said frame toward one side or the other, moving the upper opening of the passages sideways. The passages can have openings through a smaller wall, in which case gates permit the selective closing of any of the openings.

11 Claims, 6 Drawing Sheets

FIG. 1
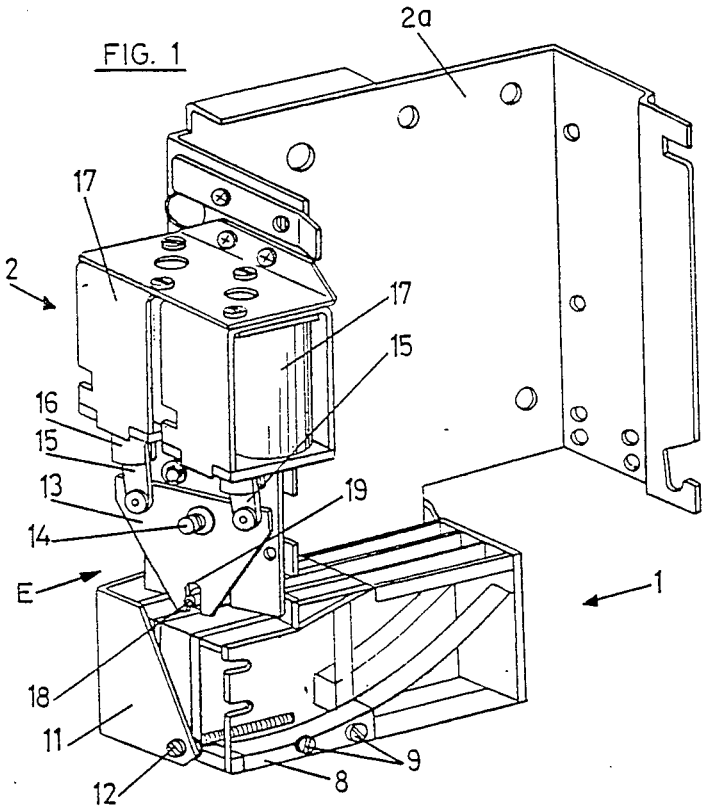
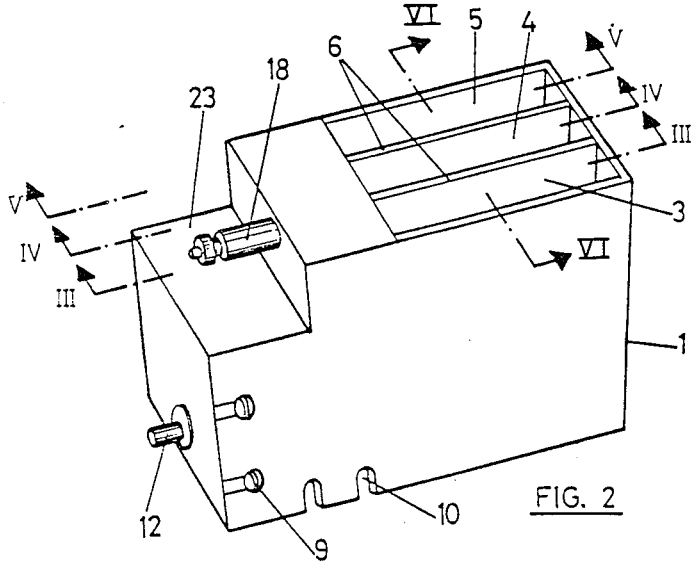
FIG. 2

FIG. 3
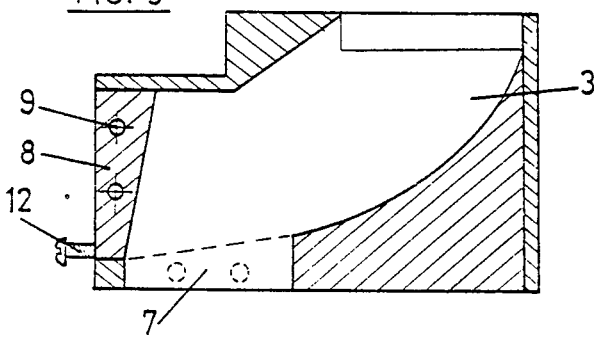
FIG. 4
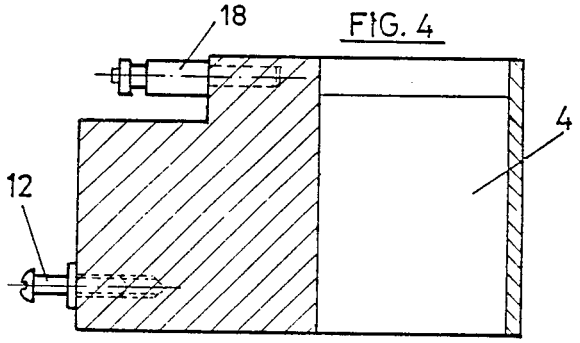
FIG. 5
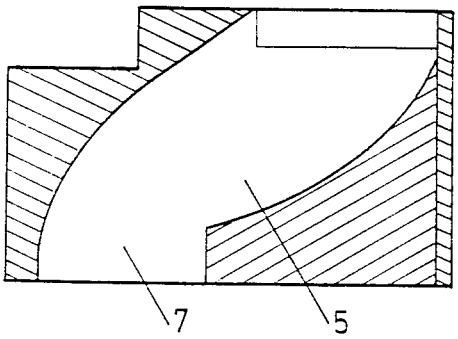
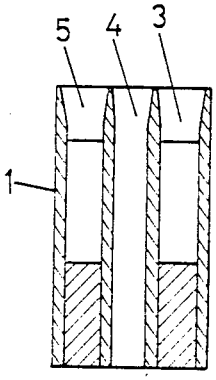
FIG. 6

FIG. 11
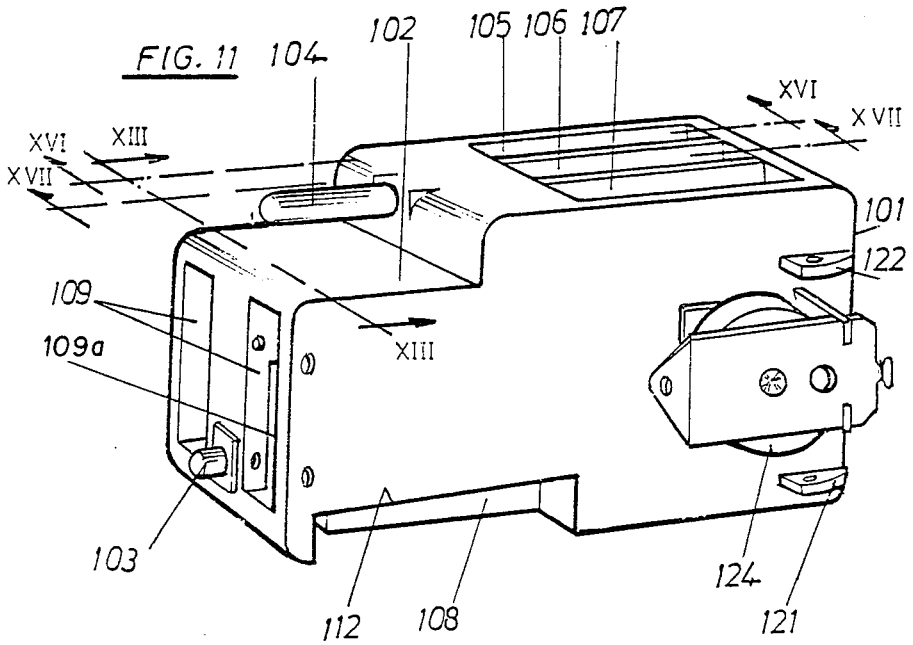
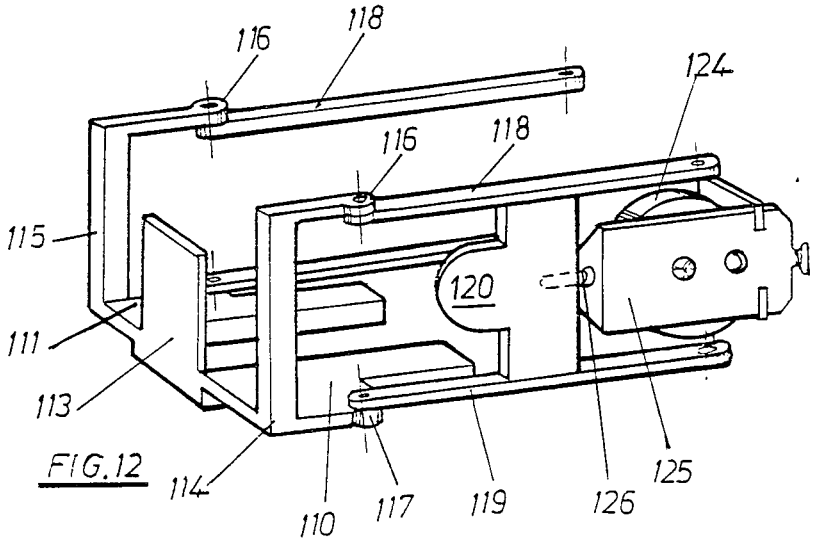
FIG. 12

FIG.16
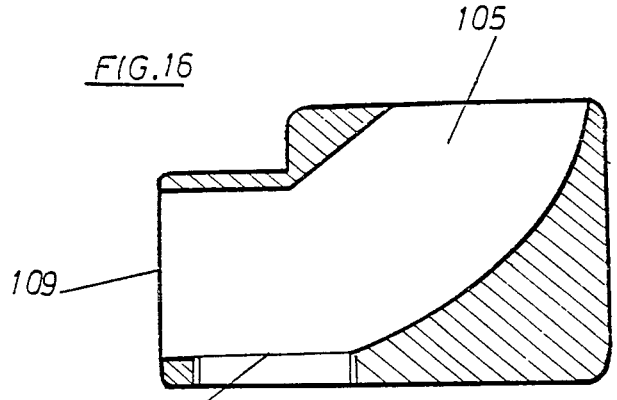
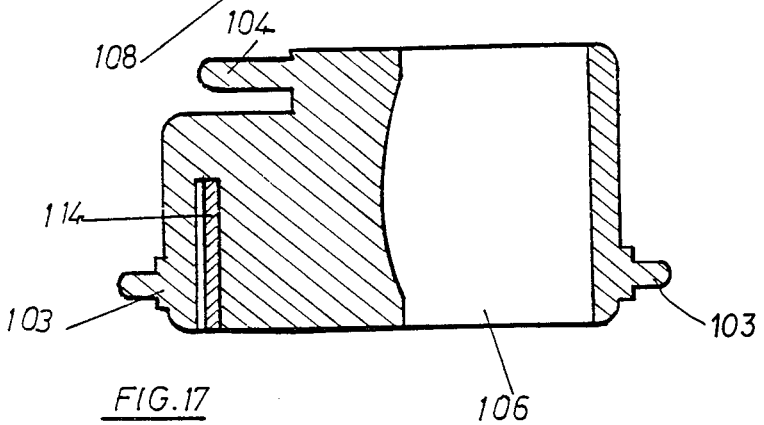
FIG.17

TILTING MULTIPLE PASSAGE RECTANGULAR BLOCK COIN SORTER

FIELD OF THE INVENTION

This invention relates to a coin sorter for coin-operated machines which, by means of a simple mechanism and in accordance with instructions received concerning the value of the coins inserted into the machine, separates or sorts said coins.

DESCRIPTION OF THE PRIOR ART

Coin-operated machines are equipped, in the coin entry channel, with a selector which rejects unacceptable coins and determines the value of accepted coins. It is desirable in most cases to have a means of separating or sorting the coins according to their value, which is accomplished in the prior art by means of gate systems or complicated mechanisms that make the machine more expensive, complicate assembly of the unit and, above all, increase the risk of breakdowns and jamming during operation of the machine.

SUMMARY OF THE INVENTION

The purpose of this invention is to develop a coin sorter that is simply constructed and operated, which can also be easily adapted to sort the desired number of coins.

The sorter of the invention consists of a right rectangular prismatic frame, the interior of which is subdivided into a series of consecutive, longitudinal, vertical passages. These passages have a rectangular cross section of a length and width greater than the diameter and thickness, respectively, of the largest acceptable coin. The length of the frame is sufficiently greater than that of the cross section of the channels or passages.

The upper ends of the passages or channels of the frame open out on the top of the frame through parallel, transversely aligned apertures near one of the transverse walls of said frame. The lower ends of the passages open out on the bottom through apertures in two axially shifted positions. One of the passages, for example, may be vertical, in which case the lower opening is vertically opposite the upper opening. One or more of the passages may be curved or slanted inside the frame, so that the lower opening is not aligned with the upper opening. In addition, at least one of the channels may open out selectively on the bottom of the frame or through one of its lateral walls.

The frame described is mounted on a support by means of a longitudinal spin axis, located in the median longitudinal plane of the frame, parallel to and near the bottom. The frame can tilt or rotate partially around this axis in one or the other direction. The tilting or partial rotation of the frame is accomplished by means of a drive mechanism that acts in accordance with instructions received concerning the value of the coins accepted by the machine, placing the frame in a vertical position or in a position slanting toward one side or the other, in this way positioning the entry aperture of a given passage opposite the exit of the coin selector, so that each coin travels through a given passage, from the exit of which the coin is directed to the desired chamber or point.

The drive mechanism that tilts the frame consists of at least two electromagnets which, when activated, operate on the frame in one direction or the other, causing it to tilt, or, when shut off, keep it in the vertical position.

The two electromagnets are connected to the frame by means of rods and an intermediate arm. The drive mechanism also has a means of return, consisting of springs that constantly impel the frame toward its vertical position, which is regained when the electromagnets are shut off.

It is also possible to increase the coin separating or sorting possibilities by equipping the frame included in the sorter with a system of movable gates.

According to this characteristic of the invention, the series of passages that open out below in one of the two abovementioned axial positions, also open out laterally through the smaller adjacent wall of the frame. The frame of the sorter in this case is provided with gates for the selective closing of the lower and/or the lateral openings of said series of passages, the frame also including a mechanism for operating these gates.

According to this characteristic of the invention, the sorter includes a gate for each lower opening, all these gates being located in the same plane, whereas it includes only one gate for the lateral openings. All of the gates can be moved in their plane in a direction transverse to the frame. The three gates are also connected or joined to one another, forming a single movable unit or assembly.

The gates that close the lower openings are in unaligned positions, being situated in such a way that when one of them closes the corresponding opening, the next gate is in the open position.

The gate that closes the lateral opening crosses the body of the frame transversely and is of the same width as one opening plus the thickness of the intermediate portion of the frame it crosses. This gate can move between two end positions, in both of which the same number of lateral apertures are kept open as are closed.

The assembly formed by the gates is extended, from the gates that close the lower apertures, by parallel external arms on either side of the frame, parallel to the lateral surfaces thereof, said arms being connected to these lateral surfaces of the frame by intermediate bars that are joined on one end to the frame and on the other to said arms, the axes of articulation being perpendicular to the direction of travel of the gates. Said bars are connected at an intermediate point to a drive mechanism. Said arms will be perpendicular to the gates that close the lower apertures, each bar being joined to the adjacent arm through two aligned axes and to the frame through two other axes, also aligned, all of the axes being parallel to one another.

The drive mechanism of the bars may consist of a spring that impels the bars and gates toward one of the end positions, and an electromagnet which, when activated, moves the bars and gates toward the opposite end position, overcoming the tension of the spring.

With the configuration described above the coins can be sorted by tilting the frame or by operating the gates thereof. By combining the tilting and the operation of the gates a greater coin sorting and selection capability can be achieved.

The configuration and operation of the sorter of the invention are more clearly and more fully explained in the following description, in which reference is made to the attached drawings, wherein one possible method of execution is shown by way of non-limitative example.

BRIEF DESCRIPTION OF THE DRAWINGS

FIG. 1 is a perspective view of a coin sorter built in accordance with the invention.

FIG. 2 is a perspective view of the frame which is a part of the sorter and which is equipped with three vertical passages.

FIGS. 3, 4 and 5 are sections, respectively, along lines III—III, IV—IV and V—V of FIG. 2.

FIG. 6 is a section along line VI—VI of FIG. 2.

FIG. 11 is a perspective view of a frame of a sorter modified by selective closing gates which permit increasing the sorting possibilities.

FIG. 12 is a perspective view of the gate assembly mounted on the frame shown in FIG. 11, with the drive mechanism thereof.

FIG. 16 is a section along line XVI—XVI of FIG. 11.

FIG. 17 is a section along line XVII—XVII of FIG. 11.

DESCRIPTION OF THE PREFERRED EMBODIMENTS

Figure 7:
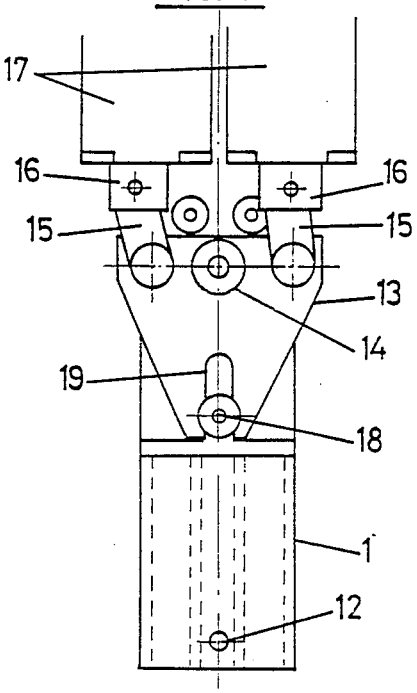
FIGS. 7, 8 and 9 are front views, from direction E of FIG. 1, of the frame and drive mechanism in three different positions.
Figure 8:
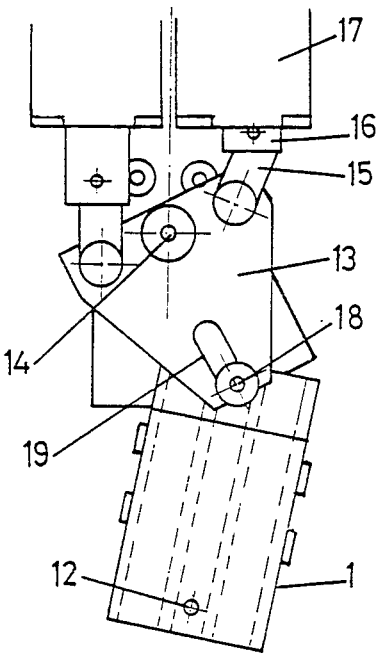

As shown in FIG. 1, the sorter consists of a right rectangular prismatic frame, designated by the number 1, and a drive mechanism for said frame, designated by the number 2, the frame and the mechanism being mounted on a support *2a*.

The interior of the frame 1, as shown in FIGS. 2–6, is subdivided into three consecutive vertical passages, designated by the numbers 3, 4 and 5, separated by intermediate partitions 6. These passages have an approximately rectangular cross section, the length and width of which are greater than the diameter and thickness, respectively, of the largest acceptable coin. The upper end of the three passages open out through apertures located on the top of the frame, in transversely aligned positions. The passages have different trajectories inside the frame and their lower ends open out through apertures that are axially shifted. Middle channel 4 passes through the interior of the frame in a vertical direction, as shown in FIG. 4, the lower opening being opposite the upper opening. Passages 3 and 5, however, shown in FIGS. 3 and 5, run obliquely, lower opening 7 being axially shifted with respect to the upper opening and also with respect to the lower opening of middle passage 4. Passage 3 can open out below, as shown in FIG. 3, or laterally through the adjacent transverse wall, including a removable piece 8 by means of which the lateral opening is closed, as shown in FIG. 3, or the lower opening 7 is closed, as represented by the dotted line in the same Figure. Piece 8 can be held in place by screws 9 turned through the notches 10 in the wall of the frame.

Frame 1 is mounted in parallel brackets 11 of support *2a*, FIG. 1, by screws 12 that form a spin axis located in the median longitudinal plane of the frame, parallel to and near the bottom thereof. The frame can tilt around this axis in one direction or the other. This tilting is controlled by drive mechanism 2.

As shown in FIGS. 1 and 7–9, the drive mechanism includes a lever 13 which rotates around pin 14. Coupled to this lever are two rods 15, at points located on either side of pin 14, which are in turn joined at their free end to the core 16 of two electromagnets 17. Lever 13 is also coupled at its opposite edge or end, via fulcrum pin 18, to frame 1. Lever 13 consists of a plate that is essentially trapezoidal in shape, which, on its smaller end, has an axial notch 19, by means of which the articulation with pin 18, which is part of the frame, is accomplished.

Figure 9:
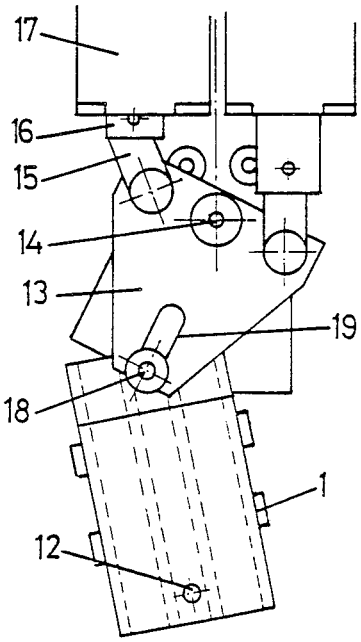

With the configuration described, when the two electromagnets 17 are turned off, frame 1 remains in the vertical position, as shown in FIG. 7. When the electromagnet 17 on the right is activated, the core 16 thereof moves upward, pulling rod 15, whch causes the rotation of lever 13 around pin 14, pin 18 being moved as a result of the existence of notch 19, whereupon frame 1 moves into the tilted position shown in FIG. 8. When this electromagnet is shut off and the opposite one is turned on, lever 13 rotates around pin 14 in the opposite direction, as shown in FIG. 9, causing frame 1 to tilt on pin 12 and to become slanted toward the side opposite that shown in FIG. 8.

Figure 10:
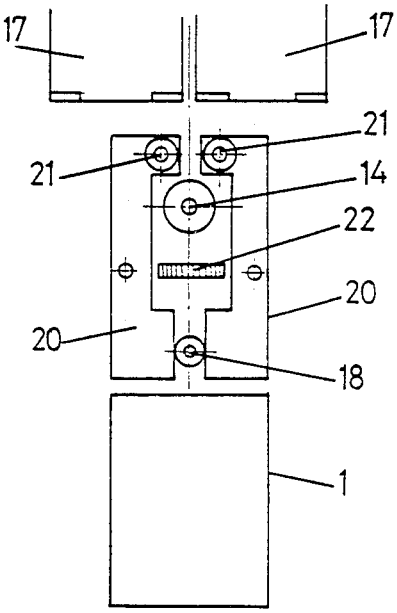
FIG. 10 is a front view of the means of return of the frame when the drive mechanism is shut off.

When the electromagnets 17 are turned off, frame 1 is in the vertical position shown in FIG. 7, due to the existence of the means of return shown in FIG. 10 and which is located immediately behind lever 13 of the drive mechanism. This means of return consists of two arms 20 which are essentially parallel and which are joined at their upper end to support *2a* by pins 21. At the bottom arms 20 rest on pin 18, which is part of frame 1. The two arms 20 are connected to one another by means of a tension spring 22. When frame 1 tilts toward one side or the other, pin 18 moves the corresponding arm, increasing the tension of spring 22 to a degree that is sufficient to return frame 1 to its vertical position when the corresponding electromagnet is turned off.

As shown in FIG. 2, frame 1 has a step 23, in the vertical portion of which is located pin 18, which fits into notch 19 of lever 13 of the drive mechanism.

Although in the example described the frame includes three channels, the number of them can vary. There can also be two frames, with the drive mechanism including three electromagnets.

The activation of one or the other of the electromagnets 17 will depend on the value of the coin passing at a given moment from the selector to the sorter. In the position shown in FIG. 7, the coins that leave the selector go through the sorter through middle channel 4, where as in the sorter position in FIG. 8, the coins pass through channel 5 and in the position shown in FIG. 9 through channel 3. In this way the coins are directed, through the corresponding channels, to different receptacles or points.

As shown in FIG. 11, the modified sorter consists of a right rectangular prismatic frame, designated by the number 101. In the upper part of this frame is a transverse step 102. Extending from the smaller transverse walls of the frame are aligned pivots or projections 103, see also FIG. 17, which constitute a spin axis around which frame 101 can tilt, driven by the corresponding mechanism, which is connected to pivot 104 which extends from the front of step 102.

The interior of frame 101, as shown in FIGS. 11, 16 and 17, is subdivided into three consecutive vertical passages, designated by the numbers 105, 106 and 107, which are separated by intermediate partitions. Said passages have an approximately rectangular cross section, the length and width of which are greater than the diameter and thickness, respectively, of the largest acceptable coin. The upper ends of these three passages open out through apertures located in the top of the frame, in transversely aligned positions. The passages have different trajectories inside the frame, their lower ends opening out through apertures that are axially shifted. Middle channel 106, as shown in FIG. 17, goes through the frame in a vertical direction, the lower opening being in a position opposite the upper opening. Outer passages 105 and 107, which have the same trajectory, run obliquely, as shown for passage 105 in FIG. 16, and have two openings, one on the bottom, designated by the number 108, and a lateral one, designated by the number 109. Bottom opening 108 is axially displaced with respect to the upper opening of the same passage and also with respect to the lower opening of middle passage 106.

The frame described is mounted on a support such as support 2*a* of FIG. 1 and connected to a mechanism such as that designated by number 2 in FIG. 1, which causes the rocking of the frame, making it rotate partially around the axis formed by the two aligned pivots 103. By means of said drive mechanism, the exit of the selector is positioned opposite the mouth of one of passages 105, 106, or 107, through which the coin is directed to the corresponding compartment for sorting or rejection.

According to this invention, the frame includes gates for the selective closing of the lower openings 108 and/or lateral openings 109 of passages 105 and 107. Frame 101 also has a mechanism for operating these gates.

In FIG. 12 a perspective view is given of the gate assembly and its driving mechanisms.

For the selective closing of the lower openings 108 of passages 105 and 107 there are two gates, designated by the numbers 110 and 111, which are located in the same plane. These gates can be moved in their plane, in a direction transverse to frame 101, through housings 112 in the lower part of said frame, on either side of the lower openings 108.

The gate assembly also includes a gate 113, perpendicular to the others, which can be moved in a direction transverse to the frame through a passage 109*a* formed behind the partition that separates openings 109 of passages 105 and 107. The width of gate 113 is equal to width of one opening 109 plus the partition separating both openings 109 such that when the gate 113 is moved from one to the other of its end positions, it always closes one of the openings 109 and opens the other. The separation and dimensions of lower gates 110 and 111 are such that when these gates move from one to the other of their end positions, they close one of the lower openings 108 and open the other. It is also necessary, when vertical gate 113 closes the opening of one of the passages, that the lower opening of that passage be kept open and vice-versa.

As shown in FIG. 12, the three gates 110, 111 and 113 form a unit. Extending from gates 110 and 111 are lateral arms 114 and 115, located on either side of the longitudinal walls of frame 101 and parallel to said walls. Each of the arms 114 and 115 includes two points of articulation, an upper one 116 and a lower one 117, to which are connected, through aligned axes, two other sets of bars, 118 and 119, which are connected to one another by means of an intermediate plate 120, each pair of upper and lower arms forming a single unit. Bars 118 and 119 are fastened at their free end to lugs 121 and 122, FIG. 11, which are part of frame 101, through two aligned axes parallel to the axes of the points of articulation 116 and 117.

Figure 13:
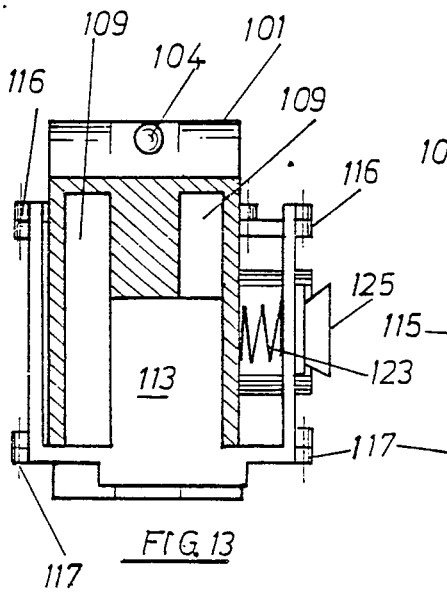
FIG. 13 is a section along line XIII—XIII of FIG. 11, in the same plane as that of the gate that closes the lateral openings of the passages.
Figure 15:
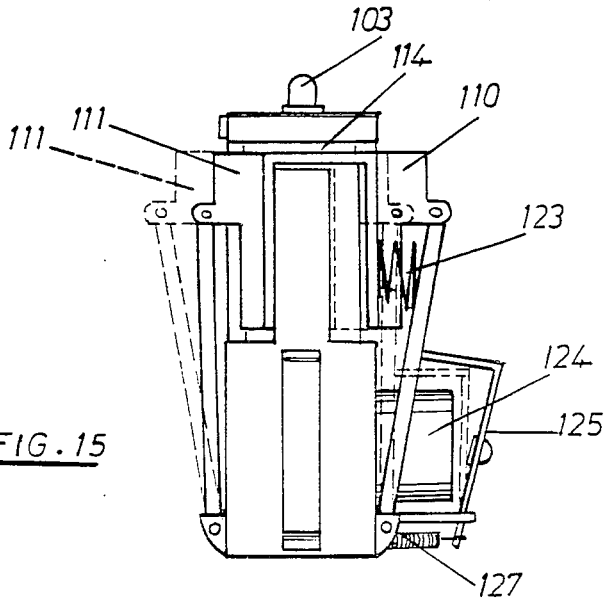
FIG. 15 is a bottom view of the frame shown in FIG. 11.

The assembly of gates and bars described, mounted on frame 101, are impelled toward one of the end positions of the gates by spring 123, FIG. 13, which is mounted between said frame and connecting plate 120 of bars 118 and 119 on one side. In this position, as shown in FIG. 13, gate 113 closes opening 109 of passage 107, while leaving opening 109 of passage 105 open. In this situation, the lower gates are in the position represented by solid lines in FIG. 15, in which gate 110 closes the lower opening of passage 105, while leaving the lower opening of passage 107 open.

Figure 14:
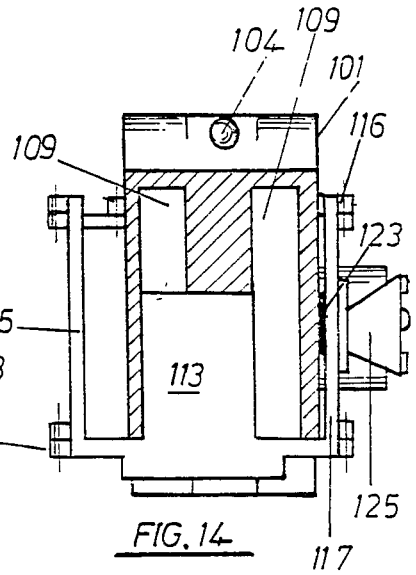
FIG. 14 is a section identical to that of FIG. 13, in which the lateral gate is in the opposite end position.

When the set of bars moves against the force of spring 123, gate 113 moves into the position shown in FIG. 14, in which it opens the lateral opening 109 of passage 107 and closes the lateral opening 109 of passage 105. The lower gates are in the position shown in FIG. 15 by dotted lines, in which gate 111 opens the lower opening of passage 105 and closes the lower opening of passage 107.

The movement of the set of bars against the force of spring 123 can be effected by an electromagnet 124, which, when activated, attracts plate 125 resting on stem 126, which is part of plate 120, moving the set of bars and the gates with it, across arm 114.

Plate 125 is also conneced to a return spring 127.

With the configuration described, the sorting of coins can be accomplished by tilting frame 101, as described in connection with FIGS. 1–10, or by operating gates 110, 111 and 113. Selection can also be accomplished by combining the movement of the gates and the tilting movement of the frame, whereby a greater sorting and selection capability is achieved.

Having sufficiently described the nature of the invention, as well as the manner of executing it in practice, it must be stated that the configurations indicated above and represented in the attached drawings are subject to modifications of detail which in no way alter its basic principle.

What is claimed is:

1. A coin sorter for coin-operated machines, comprising a right rectangular prismatic frame, the interior of which is subdivided into consecutive, longitudinal, vertical passages having a rectangular section, the length and width of which are greater than the diameter and thickness, respectively, of the largest acceptable coin, but length of which is less than that of the frame; said passages having upper ends which open out on the top of the frame through parallel, transversely aligned openings, and having lower ends which open out on the bottom through openings in two axially shifted positions; at least one of the passages having a second lower lateral opening; and a piece that can be attached to said lower openings of said one passage to block one of the lower openings of the one passage; said frame being mounted so as to be able to rotate around a medium axis parallel to and near the bottom of the frame; and a mechanism connected to the frame for partially tilting said frame toward one side or the other, away from a vertical central position, moving the upper openings of the passages sideways.

2. A coin sorter for coin-operated machines, comprising a right rectangular prismatic frame, the interior of which is subdivided into consecutive, longitudinal, vertical passages having a rectangular section, the length and width of which are greater than the diameter and thickness, respectively, of the largest acceptable coin, but length of which is less than that of the frame; said passages having upper ends which open out on the top of the frame through parallel, transversely aligned openings, and having lower ends which open out on the bottom through openings in two axially shifted positions; said frame being mounted so as to be able to rotate around a medium axis parallel to and near the bottom of the frame; and a mechanism connected to the frame for partially tilting said frame toward one side or the other, away from a vertical central position, moving the upper openings of the passages sideways; the mechanism for tilting the frame including a lever with an intermediate spin axis located above said frame; the lever being articulately joined at its lower end to the frame; the axis of articulation between the lever and the frame, the spin axis of said lever and a spin axis of the frame all being located in the same plane; two electromagnets; two rods articulately joining the top of the lever to the respective electromagnets for pivoting the lever in respective directions about its spin axis when the electromagnets are energized, the points of articulation of the rods with said lever being horizontally displaced from the spin axis of the lever and located one on each side of said spin axis of the lever; said mechanism also having means of return which impels the frame toward its vertical central position.

3. A sorter according to claim 2, wherein the mechanism for tilting the frame includes a fulcrum pin joining the lever and the frame; and said means of return includes two vertical arms, located one on each side of the fulcrum pin joining the lever and the frame which, arms are attached at their upper end to a stationary support and connected to one another by a tension spring, the lower ends of both arms resting against said fulcrum pin joining the lever and the frame.

4. A sorter according to claim 2, wherein the attachment of the lever at its lower end to the frame is accomplished by means of a fulcrum pin which is part of the frame, and a central axial notch in the lower part of said lever, which notch holds the fulcrum pin.

5. A sorter according to claim 4, wherein the lever of said mechanism is flat and trapezoidal in shape, the notch which permits attachment to the frame being made in the lower part, while the points of articulation with the rods are located near the top.

6. A coin starter for coin-operated machines, comprising a right rectangular prismatic frame, the interior of which is subdivided into consecutive, longitudinal, vertical passages having a rectangular section, the length and width of which are greater than the diameter and thickness, respectively, of the largest acceptable coin, but length of which is less than that of the frame; said passages having upper ends which open out on the top of the frame through parallel, transversely aligned openings, and having lower ends which open out on the bottom through openings in two axially shifted positions; said frame being mounted so as to be able to rotate around a medium axis parallel to and near the bottom of the frame; a mechanism connected to the frame for partially tilting said frame toward one side or the other, away from a vertical central position, moving the upper openings of the passages sideways; said passages including a pair of passages that open out on the bottom in one of the two axial positions, and also open out laterally through a wall of the frame; and said frame having gates for selectively closing the bottom and lateral openings of said pair of passages, as well as a drive mechanism for operating said gates such that only one of the two openings of a selected passage of said pair of passages is open at any given time.

7. A sorter according to claim 6, wherein said gates include a gate for each bottom opening, both in the same plane, and a single gate for the lateral openings, all of these gates being capable of movement in their plane in a direction transverse to the frame, and the three gates being interconnected; the gates that close the bottom openings being in axially shifted positions, so that when one of them closes the corresponding opening, the other is located in the open position; and the gate that closes the lateral openings extends across a portion of the body of the frame transversely and is of the same width as that of one opening plus the thickness of an intermediate portion of the frame between the pair of lateral openings, this gate being movable between two end positions, in each of which the same number of lateral openings are kept open as are closed.

8. A sorter according to claim 6, including parallel external arms which extend from the gates that close the bottom openings; intermediate bars having one end attached to the frame and having their other end attached to said arms, along axes perpendicular to the direction of travel of the gates; and said bars having an intermediate point connected to the drive mechanism.

9. A sorter according to claim 8 wherein the arms extending from the gates are perpendicular to the gates that close the bottom openings; and each bar is attached to the adjacent arm and the frame through two respective axes aligned with the frame all of which axes are parallel to one another.

10. A sorter according to claim 8 wherein the drive mechanism includes a spring which impels the bars and gates toward one end position; and an electromagnet which, when activated, moves the bars and gates toward an end position opposite the one end position, overcoming the tension of the spring.

11. A sorter according to claim 9 wherein the drive mechanism includes a spring which impels the bars and gates toward one end position; and an electromagnet which, when activated, moves the bars and gates toward an end position opposite the one end position, overcoming the tension of the spring.

* * * * *